United States Patent [19]

Pamplin et al.

[11] 4,120,186

[45] Oct. 17, 1978

[54] MULTI-DIE/BLOCK DRAWING MACHINES

[75] Inventors: John Warner Pamplin, Bishop Auckland; James Vine Bennett; Peter Fred Elson, both of Eastleigh, all of England

[73] Assignee: Marshall Richards Barcro Limited, Crook, England

[21] Appl. No.: 802,507

[22] Filed: Jun. 1, 1977

[30] Foreign Application Priority Data

Jun. 4, 1976 [GB] United Kingdom ..... 23126/76

[51] Int. Cl.[2] ..... B21C 1/00

[52] U.S. Cl. ..... 72/278; 72/377; 283/44

[58] Field of Search ..... 72/274, 278, 279, 280, 72/281, 282, 377; 283/1 A, 44

[56] References Cited

PUBLICATIONS

Wire Drawing and the Cold Working of Steel; Adam, Alastair Thomas; pp. 51–55 (1925).

*Primary Examiner*—Michael J. Keenan

*Attorney, Agent, or Firm*—Prutzman, Kalb, Chilton & Alix

[57] ABSTRACT

This invention relates to a method of determining the sequence of die sizes to be used in a multi-die/block drawing machine to draw metal from any given input stock size to any given final wire size to give optimum efficiency and proposes nomograms for achieving the sequence quickly and easily.

4 Claims, 4 Drawing Figures

MULTI-DIE/BLOCK DRAWING MACHINES

Figure 1:
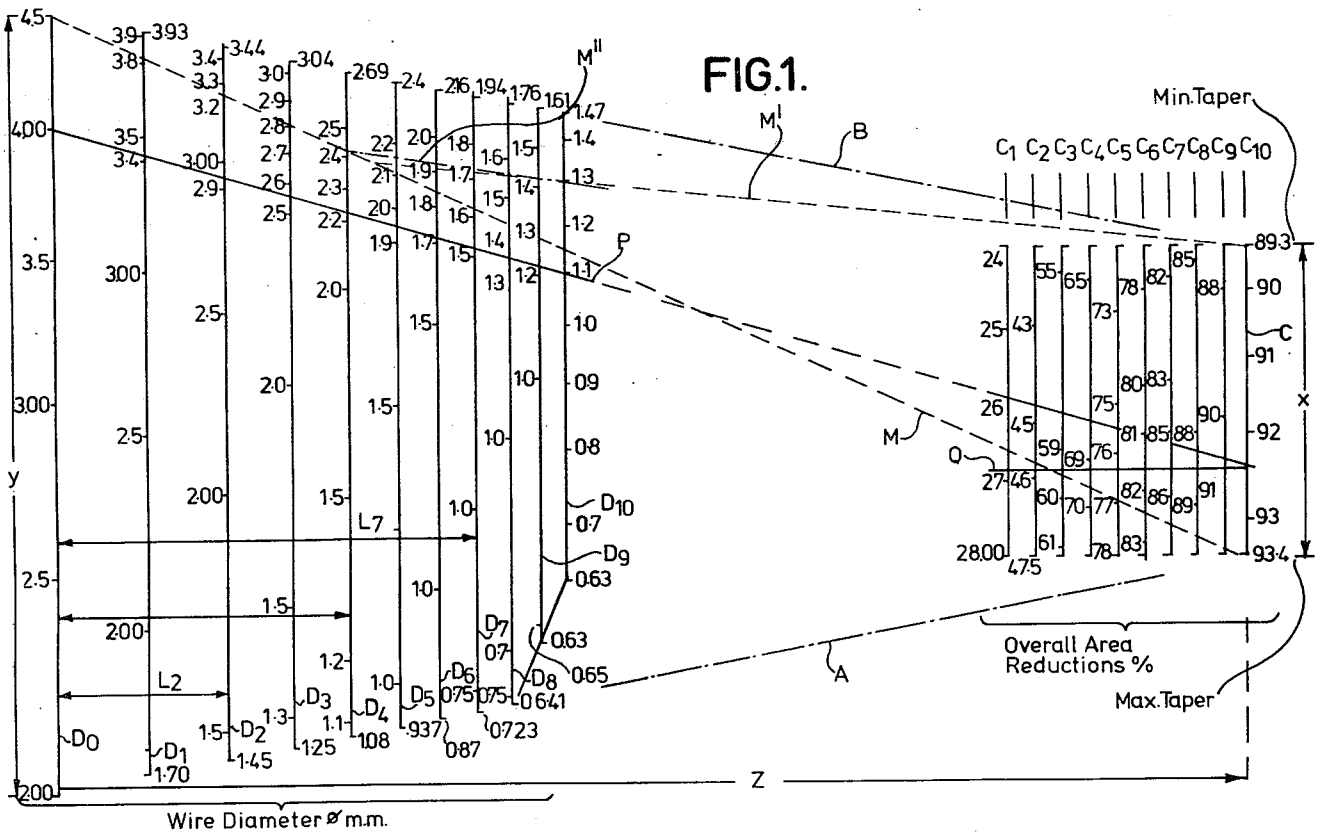

This invention relates to a method of determining a drafting sequence for a multi-die/block drawing machine and to equipment for use in the method.

When using a multi-die/block drawing machine to draw from input stock of given cross-sectional area to end product of a different but smaller cross-sectional area it is necessary to choose carefully the cross-sectional areas of the die openings of the various dies used (i.e., to choose the correct drafting sequence) if optimum efficiency is to be obtained. If the areal reduction between any two successive dies is unduly large the overall speed at which the machine can be operated will be reduced because although the maximum power available will be utilized at the block which is making the unduly large reduction, less than maximum power will be used at all the other blocks. Conversely inefficient use of the available power will result if one die is chosen to give too small an areal reduction since to utilize the maximum power available on the block drawing the wire through this oversized die would result in overloading of most, if not all of the other blocks. Further, effective operation of a multi-die drawing machine relies upon the tension in the drawn material leaving each die lying within a range which has as its upper limit a value related to the tensile strength of the wire and has as its lower limit a value which ensures correct passage of the material around the block. Further, leaving aside the efficiency of the drawing process, the quality of the end product produced is adversely affected by a wrong drafting sequence.

Determining the correct drafting sequence for any given material on a particular machine for specified input stock and end product has heretofore been a tedious operation recourse being made to lengthy calculations which in part require the application of trial and error procedure and great experience.

It is known for manufacturers of multi-die/block drawing machines to provide a purchaser with some typical schedules but in practice the actual sequence required is probably not among the schedules provided leaving the purchaser to extrapolate from the sequences available.

It has been long appreciated that a desirable drafting sequence is one in which there is approximate equality between the energy requirements necessary to drive each block and the usual trial and error procedure for calculating a drafting sequence relies on this for all but the first block (the first block is sometimes treated differently from the other blocks in the series to provide only a "light draw" at the inlet die and thereby allow for the possibility of the input stock being somewhat ovesized). What has been needed is some simple method of determining the die sequence to give a substantially uniform energy demand on the motive means driving each block. The invention provides such a method and further enables the construction of charts and other devices which give the required sequence very rapidly.

According to one aspect of the invention a method of determining a drafting sequence for a multi-die/block drawing machine comprises choosing each pair of adjacent dies so that the logarithm of the ratio of the product of the initial and final cross-sectional areas of material approaching and leaving the die pair to the square of the cross-sectional area of the material between the dies of the pair is substantially a constant throughout the sequence.

Throughout this specification this method of determining a drafting sequence will be known as "the stated method."

The stated method can be used to determine, for any given machine and any particular material (e.g., high carbon steel) a drafting sequence for a maximum taper and a drafting sequence for a minimum taper, these sequences then being used in accordance with a particularly favourable embodiment of the invention to enable other intermediate sequences to be read off directly from a chart.

Taper drafting is the name given to a drafting sequence in which the percentage areal reduction produced at each successive die gradually reduces in value from the input die (or the first die after the input die) to the output die of the sequence. A "maximum taper" draft is defined as the taper draft which will efficiently (having regard to the parameters of the machine) achieve the maximum possible overall percentage areal reduction from input stock to final product and a "minimum taper" draft is a taper draft in which the percentage areal reduction from input stock to final product is the minimum that can be efficiently achieved on the machine.

According to a further aspect of the invention a method of determining the drafting sequence for a multi-die/block drawing machine operating with circular cross-section material comprises determining a die sequence for a maximum taper on the basis of the stated method starting from an early die (normally the first or second) and assuming a reasonable maximum area reduction at that early die and determining a die sequence for a minimum taper on the basis of the stated method starting from the final die assuming a minimum area reduction at that final die to give acceptable machine performance, displaying the input stock size and the die sequence for the maximum taper as diameters for the input stock and the various dies spaced apart along one limit line of a nomogram and the input size and the die sequence for the minimum taper as die diameters for the input stock and the various dies spaced apart along a further limit line, spacing the diameters for the input stock and the various dies along each limit line at a distance $(Z-L_n)$ from a base line, joining the designations for the input stock and each die on each limit line by a plurality of parallel lines (input stock line and die lines) and graduating each such line between the limit lines in accordance with the modulus $M_{d_\eta}$ and then selecting the die sequence as the points where a straight line which passes through the desired points on the input stock line and the final die line and which intersects the base line, crosses the graduations of the other die lines, where $Y_\eta$ equals the physical length of the stock or die line in question, $d_{\eta_{max}}$ equals the diameter of the stock ($n=0$) or die ($n$ equals the die number) under conditions of maximum taper and $d_{\eta_{min}}$ equals the appropriate diameter under conditions of minimum taper, Z equals the physical separation between the input stock line and the base line, $$L_n = \frac{Z \cdot M_{d_n}}{M_{d_n} + M_{\frac{1}{2}\log(1-R_n)}} \text{ where}$$

$$M_{d_n} = \frac{Y_n}{\log d_{n_{max}} - \log d_{n_{min}}} \text{ and}$$

-continued $$M_{\frac{1}{2}\log(1-R_n)} = \frac{x}{\frac{1}{2}[\log(1-R_{n_{min}}) - \log(1-R_{n_{max}})]}$$

$R_{\eta max}$ being the maximum overall reduction and $R_{\eta min}$ the minimum overall reduction at the $n^{th}$ die.

The invention also relates to equipment which permits the drafting sequences to be determined and also to equipment which enables other parameters relating to a drafting sequence (such as speed of exit of end product from the machine) to be readily determined.

Figure 2:
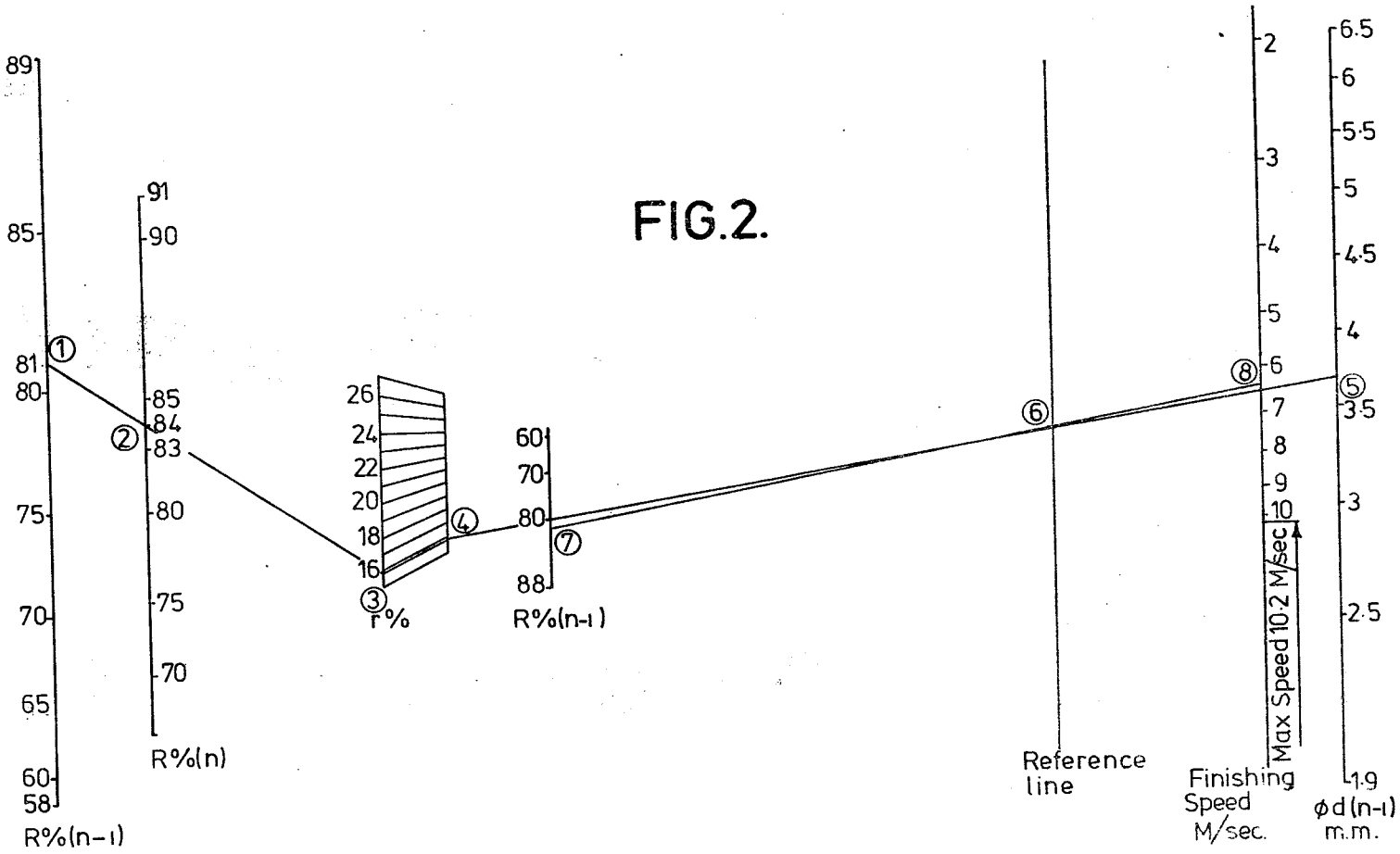
Figure 3:
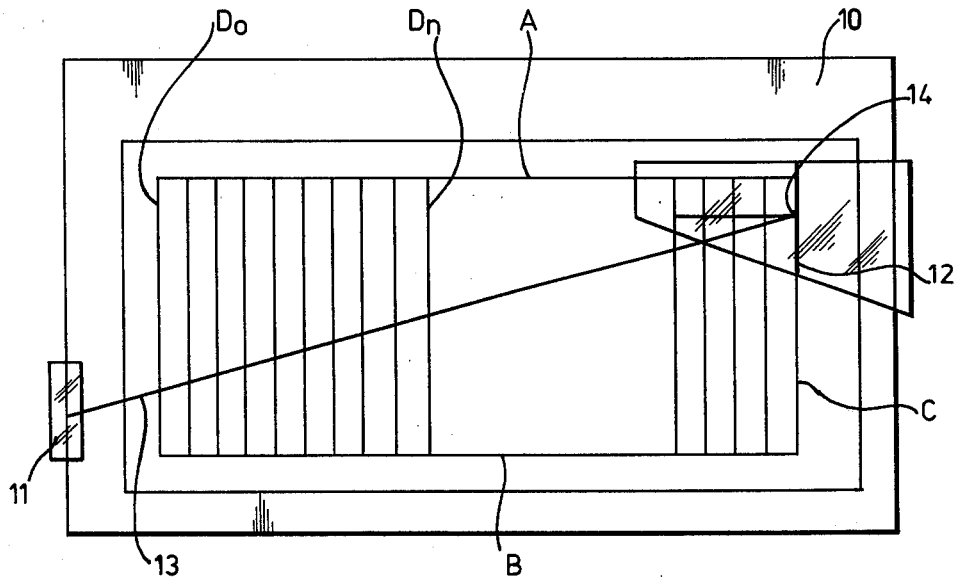
Figure 4:
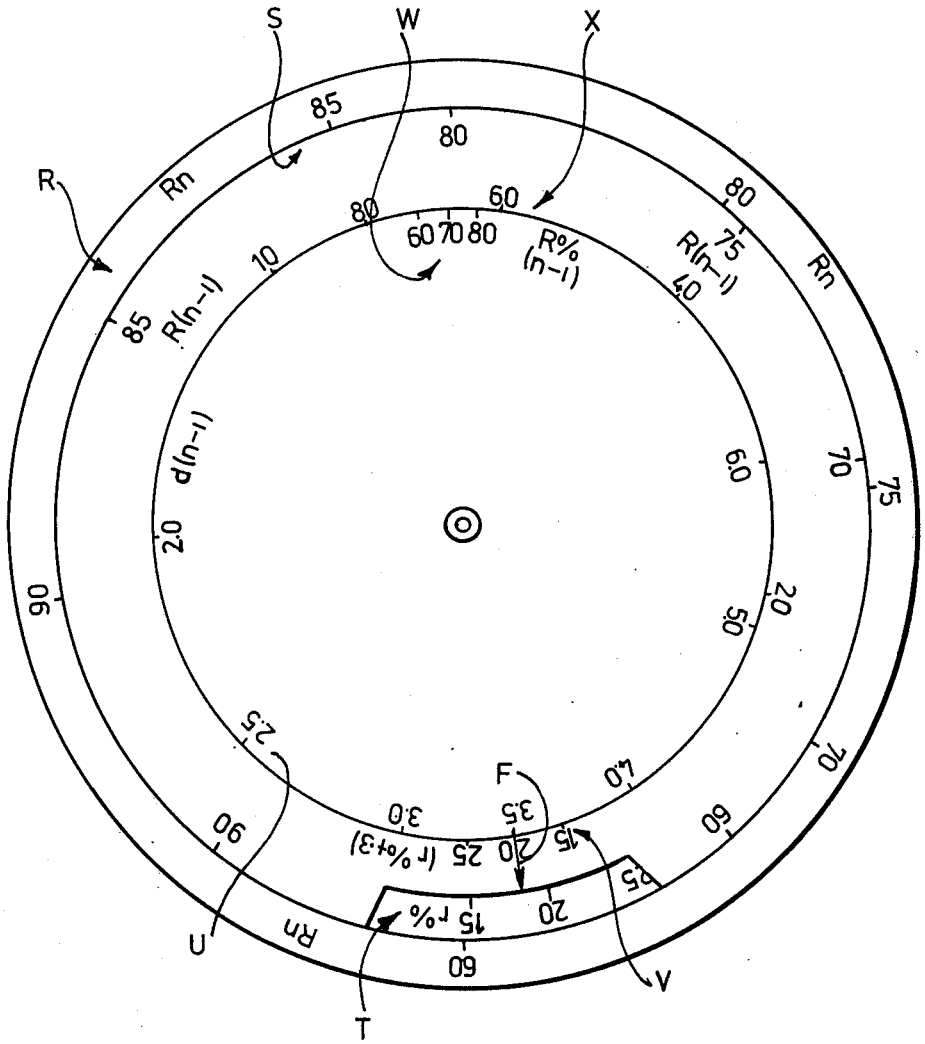

The invention will now be further described by way of example with reference to the accompanying drawings, in which:

FIG. 1 is a first nomogram for determining in accordance with the method of the invention the die sequence of a 10-block wire drawing machine, FIG. 2 is a second nomogram for deriving other parameters of a drawing seqeunce from the nomogram of the type shown in FIG. 1, and FIGS. 3 and 4 are alternative devices for deriving information about a draft.

The derivation of the nomogram shown in FIG. 1 is as follows:

if $Ao$ is the cross-sectional area of the input stock and $An$ the cross-sectional area of the end product (i.e., there are $n$ dies) then $$\frac{Ao}{An} = \frac{Ao}{A_1} \times \frac{A_1}{A_2} \cdots \frac{An-1}{An},$$

$A_1, A_2 \ldots An-1$ being the areas of the material as it passes through the first, second and $(n-1)^{th}$ dies, respectively. If the overall areal reduction produced by the $n$ dies is R then $R = Ao-An/Ao$ from which it follows that $Ao/An = 1/1-R$. The intermediate areal reductions ($r$) for each die can be similarly obtained so that $$\frac{Ao}{A_1} = \frac{1}{1-r_1} : \frac{A_1}{A_2} = \frac{1}{1-r_2} : \ldots \frac{An-1}{An} = \frac{1}{1-r_n}$$

from which it appears $$\log_e \frac{1}{1-R} = \log_e \frac{1}{1-r_1} + \log_e \frac{1}{1-r_2} + \ldots + \log_e \frac{1}{1-r_n}$$

We now assume that a taper draft will be acceptable if $$\left(\log_e \frac{1}{1-r_1} - \log_e \frac{1}{1-r_2}\right) = \ldots = \left(\log_e \frac{1}{1-r_{n-1}} - \log_e \frac{1}{1-r_n}\right) = x$$

or $$\left(\log_e \frac{Ao}{A_1} - \log_e \frac{A_1}{A_2}\right) = \ldots = \left(\log_e \frac{An-2}{An-1} - \log_e \frac{An-1}{An}\right) = x$$

or

-continued $$x = \log_e\left(\frac{AoA_2}{A_1^2}\right) = \ldots = \log_e\left(\frac{An-2 \cdot An}{An-1^2}\right)$$

Thus we see that for a taper draft to be acceptable, the logarithm of the ratio of the product of the initial and final cross-sectional areas of material approaching and leaving the die pair to the square of the cross-sectional area of the material between the dies of that pair is $x$ and is substantially constant throughout the sequence. This assumption constitutes the basis for the stated method of determining any acceptable drafting sequence. The stated method proceeds as follows:

if $x$ is constant throughout the die sequence it follows: that $$\log_e \frac{1}{1-R} = n \log_e \frac{1}{1-r_n} + \frac{x}{2}(n(n-1))$$

and hence $$x = \frac{2}{n(n-1)}\left[\log_e \frac{1}{1-R} - n \log_e \frac{1}{1-r_n}\right]$$

This equation enables the individual reductions at the next following (or next preceding) die to be calculated from the general formula $$\log_e \frac{1}{1-r_i} = \log_e \frac{1}{1-r_n} \pm x(n-i)$$

where $i$ refers to the intermediate die in question.

We are now in a position to calculate the sequences for maximum and minimum taper drafts and for example, will consider the case of a 10-die D.C. machine drawing high carbon steel (H.C.S.) wire and with 30 KW motors on each block of 460 mm diameter. For the machine parameters we establish that using all 10 blocks, the maximum reduction in area (R max) is 93.4% and the minimum reduction in area (R min) is 89.3%.

Calculation of die sequence for Minimum Taper Draft

Number of dies = 10.

Minimum overall reduction in area (R min) is 89.3%

Minimum acceptable reduction in area at any die ($r$ min) is 16% assumed at die 10.

$$X = \frac{2}{10 \times 9}\left(\log_e \frac{1}{1-0.893} - 10 \log_e \frac{1}{1-.16}\right)$$

Thus

Which gives X = 0.01092.

| Die No. | $\log_e \frac{1}{1-r_i}$ | $\frac{1}{1-r_i}$ | $r_i \times 100\%$ |
|---|---|---|---|
| 10 | 0.174 | 1.19 | 16.00 |
| 9 | 0.185 | 1.204 | 16.91 |
| 8 | 0.196 | 1.217 | 17.81 |
| 7 | 0.207 | 1.230 | 18.71 |
| 6 | 0.218 | 1.244 | 19.59 |
| 5 | 0.229 | 1.257 | 20.46 |
| 4 | 0.240 | 1.271 | 21.33 |
| 3 | 0.251 | 1.285 | 22.18 |
| 2 | 0.262 | 1.299 | 23.03 |
| 1 | 0.273 | 1.313 | 23.86 |

(Where $r_i$ is the areal reduction in percentage divided by 100 at the die in question.)

Calculation of the area reductions at the dies for Maximum Taper

Drafting

No. of dies = 10.

Maximum overall reduction in area using 10 dies ($R_{max}$) = 93.4%.

Maximum selected reduction in area at any die ($r_{max}$) is 28.00% (usually at No. 1 die). Thus, $$X = \frac{2}{10 \times 9}\left(\log_e \frac{1}{1-0.934} - 10 \log_e \frac{1}{1-0.28}\right)$$

Which gives X = 0.0126.

| Die No. | $\log_e \frac{1}{1-r_i}$ | $\frac{1}{1-r_i}$ | $r_i \times 100\%$ |
|---|---|---|---|
| 1 | 0.329 | 1.389 | 28.00 |
| 2 | 0.316 | 1.372 | 27.09 |
| 3 | 0.303 | 1.354 | 26.16 |
| 4 | 0.291 | 1.337 | 25.23 |
| 5 | 0.278 | 1.321 | 24.28 |
| 6 | 0.266 | 1.304 | 23.32 |
| 7 | 0.253 | 1.288 | 22.35 |
| 8 | 0.240 | 1.272 | 21.36 |
| 9 | 0.228 | 1.256 | 20.36 |
| 10 | 0.215 | 1.240 | 19.36 |

(Where $r_i$ is the areal reduction in percentage divided by 100 at the die in question.)

FIG. 1 shows the drafting sequences for the maximum and minimum tapers shown, respectively, along the limit lines A and B. The actual overall reduction (R) is shown along a base line C.

The dies used for the various blocks and the input stock sizes are marked along the parallel lines $D_O$ to $D_{10}$.

The scaling of the graduations along each line $D_O$ to $D_{10}$ and the spacing of these lines from the base line C are determined according to the following rules where the physical length of the line C is taken as "x," the physical length of any given line $D_O$ to $D_{10}$ is "$y_\eta$" and physical separation of $D_O$ from C is "z" and the spacing of each line $D_1$ to $D_{10}$ from the line $D_O$ is $L_1$ to $L_{10}$ respectively (only the spacings of the lines $D_2$, $D_4$ and $D_7$ having been shown to avoid crowding of the chart).

The modulus $d_\eta(M_{d_n})$ along the line $D_n$ which has a physical length of $y_n$ is given by $$M_{d_n} = \frac{y_n}{\log d_{n_{max}} - \log d_{n_{min}}}$$

($d_{max}$ and $d_{min}$ being the diameters on the lines B and A respectively)

The modulus $\frac{1}{2}[\log_e(1-R_n)]$ ($M_c$) along the line C is given by $$M_c = \frac{x}{\frac{1}{2}[\log_e(1-R_{min}) - \log_e(-R_{max})]}$$

Further $L_n$ is given by $$\frac{Z \cdot M_{d_n}}{M_{d_n} + M_c}$$

To use the chart shown in FIG. 1 one merely needs to draw a straight line (e.g., line P) through a diameter marking on line $D_O$ which represents the input stock size and a diameter marking on the line $D_{10}$ which represents the desired diameter of the end product to be produced. If this line crosses line 'C' the draft is suitably within the parameters of maximum and minimum taper drafts selected for the machine in question and the actual die sizes required for the intermediate blocks are shown where the line 'P' intersects the lines $D_1 - D_{10}$. The die sizes thus selected, always conform to the method of calculation previously divulged and in use would give a substantially uniform energy demand from the motors at each block. The chart can be used for "short holing" (i.e., not using the last block or the last two blocks for example) and will then work in a similar way provided the line P intersects the D line corresponding to the last block used at the reading corresponding to the end product diameter and intersects the line C.

FIG. 1 also shows additional base lines ($C_1 - C_{10}$) corresponding to the 10 blocks of the machine and these and useful for giving the overall reductions at these blocks. When reading reductions from these additional base lines they should be considered to be collinear with the line C and the value thereon are obtained by projecting back from line C as shown by the line Q in FIG. 1.

To establish the lines $C_1 - C_{10}$ a table should be prepared to show the overall reductions in area at each block from the inletting wire or rod size. These results can be derived with simplicity from the reductions in area given at each die calculated previously.

i.e., $1 - R_n = (1-r_1) \times (1 - r_2)\, x \cdots (1-r_n)$ for the machine under consideration:

| Block No. | | 1 | 2 | 3 | 4 | 5 | 6 | 7 | 8 | 9 | 10 |
|---|---|---|---|---|---|---|---|---|---|---|---|
| r% | Min.T | 23.86 | 23.03 | 22.18 | 21.33 | 20.46 | 19.59 | 18.71 | 17.81 | 16.91 | 16.00 |
| r% | Max T | 28.00 | 27.09 | 26.16 | 25.23 | 24.28 | 23.32 | 22.35 | 21.36 | 20.36 | 19.36 |
| R% | Min T | 23.86 | 41.39 | 54.39 | 64.12 | 71.46 | 77.05 | 81.35 | 84.67 | 87.2 | 89.30 |
| R% | Max T | 28.00 | 47.50 | 61.24 | 71.02 | 78.05 | 83.17 | 86.93 | 89.72 | 91.82 | 93.40 |

The spacing between lines $C_1 - C_{10}$ is of no consequence. From the equation $$M_{\frac{1}{2}\log(1-R_n)} = \frac{X}{\frac{1}{2}[(\log(1-R_{n_{min}}) - \log(1-R_{n_{max}})]}$$

and by varying the values of $(1-R_{n_{min}})$ in the above equation, the spacing of intermediate values of 1 − R between $(1 - R_{n_{min}})$ and $(1 - R_{n_{max}})$ for line $C_n$ can be found.

FIG. 3 shows equipment which includes a chart such as shown in FIG. 1. The chart is incorporated on a board 10 provided with sliders 11 and 12 along opposite edges thereof. The sliders are linked by an extensible cord 13 and where the cord meets the line C of the chart a horizontal cursor line 14 is provided. To use this equipment the cord 13 traces the line P and the line 14 represents the line Q.

It is normally desirable to be able to calculate the drawing speed as well as the drafting schedule and this can be done with the help of the chart shown in FIG. 2.

This is a nomogram based on the formula $$S_i = \frac{Kw}{T_o \times (r_i + 0.3) \times d_{(i-1)}^2 \times \frac{\pi}{4} \times 0.00981 \times 0.8602}$$

where $S_i$ = wire speed at the $i^{th}$ die

Kw is the power (in kilowatts) consumed by the motor of the $i^{th}$ block $T_o$ is the tensile strength of the wire before it enters the $i^{th}$ die (in kg/mm$^2$)

$r_i$ is the areal reduction at the $i^{th}$ die $d_{(i-1)}$ is the diameter of the wire (in mm) before it enters the $i^{th}$ die.

(The numbers in the formula are various factors characteristic of the particular machine used by the applicants).

When it is the exit speed which is required on the machine to which FIG. 1 refers a chart such as that shown in FIG. 2 can be employed. The instructions for its use can easily be followed from the statements marked thereon. (Note the actual chart shown in FIG. 2 relates to a different machine from that used for FIG. 1 but the principle of operation is unchanged.)

Instead of using a nomogram as shown in FIG. 2 to calculate the wire speed a circular calculator shown in FIG. 4 can be used. This has seven scales. There is an outer scale (R) graduated in $R_n$, and a relatively movable adjacent scale (S) graduated in $R_{(n-1)}$ by which the appropriate figures read from scales C and $C_{10}$ on FIG. 1 can be aligned. The pointer F then indicates a value for $r$ to be read on a scale (T) which is fixed with regard to the scale R. The value of $d_{(n-1)}$ read from FIG. 1 is then noted on a scale (U) and this is set opposite the figure on a scale (V) which corresponds to that found on the scale (T). The remaining scales W and X enable the finishing speed to be read off the scale X opposite the value of $R_{(n-1)}$ (derived from a chart such as FIG. 1) read off the scale W.

A two slider linear slide rule can be constructed with scales similar to scales R–X to provide a similar calculation, but the circular form is preferred, since this is more compact.

As an example of the power of the new method, a drafting sequence (A) in the Table below was calculated in the conventional way; the calculations taking some three working days of an experienced operator's time. The drafting sequence (B) was obtained in accordance with the method of this invention using a nomogram of the type shown in FIG. 1. Its derivation from the nomogram took under 2 minutes.

| Sequence A Die hole diameter (mm) | Die | Sequence B Die hole diameter (mm) |
|---|---|---|
| 6.37 | 1 | 6.28 |
| 5.60 | 2 | 5.56 |
| 4.94 | 3 | 4.95 |
| 4.39 | 4 | 4.42 |
| 3.95 | 5 | 3.98 |

-continued

| Sequence A Die hole diameter (mm) | Die | Sequence B Die hole diameter (mm) |
|---|---|---|
| 3.57 | 6 | 3.60 |
| 3.25 | 7 | 3.27 |
| 2.98 | 8 | 2.99 |
| 2.75 | 9 | 2.75 |

Sequence B is at least as good as sequence A.

The die selector nomogram, when used by the method previously described, will give a very efficient draft schedule but in practice, a slight variation to a finished wire size is often desirable and this can be achieved without resorting to a complete change of all the dies along the machine. The following method of determining how many dies to change for a particular variation of finished wire size can be most useful if a slight reduction in the efficiency of the machine can be tolerated.

Let it be assumed that a 10 die machine is to be used first to draw from an inlet size of 4.5mm diameter to a finished size of 1.15 mm and subsequently to draw the same inlet stock to a finished size of 1.30 mm diameter. For setting-up the machine for the first drawing operation the draft sequence would be selected by projecting a straight line (shown as dash line M on FIG. 1) from 4.5 on line D to 1.15 on line $D_{10}$.

The dies selected for this first sequence would be 3.82. 3.26, 2.80, 2.42, 2.11, 1.84, 1.62, 1.44, 1.28 and 1.15 mm diameter giving drafts of 28.0%, 27.1%. 26.2%, 25.3%, 24,35%. 23.4%, 22.5%, 21.5%, 20.5% and 19.5%.

To select the minimum number and size of dies to change this draft to finish at 1.3 mm diameter in 10 dies, a line (shows as dash line M′ on FIG. 1) would be projected from the minimum taper end of the base line (C) through 1.3 on line $D_{10}$ to pass through the line of the original draft; which intersection lies between Block 4 and Block 5 (lines $D_4$ and $D_5$). Therefore the last six dies must be changed for the second sequence. Next a line (shown as chain line M″ on FIG. 1) is projected from the die size on Block 4 (the last die to remain unchanged) and the new finishing size — 1.3 on $D_{10}$. The die sizes would be 2.16 at No. 5 Block 1.93, 1.73, 1.57, 1.42 and finally 1.3 mm diameter. The area reductions now being 20.8% at No. 5 Block 20%, 19.1%, 18.3%, 17.5% and 16.6%. These can be shown in tabulated form:

| Block No. | INITIAL DRAFT Hole diameter (mm) Die Size | INITIAL DRAFT Hole diameter (mm) % Area Reduction | SECOND DRAFT Hole diameter (mm) Die Size | SECOND DRAFT Hole diameter (mm) % Area Reduction |
|---|---|---|---|---|
| 1 | 3.82 | 28.00 | 3.82 | 28.00* |
| 2 | 3.26 | 27.10 | 3.26 | 27.10* |
| 3 | 2.80 | 26.20 | 2.80 | 26.20* |
| 4 | 2.42 | 25.30 | 2.42 | 25.30* |
| 5 | 2.11 | 24.35 | 2.16 | 20.80 |
| 6 | 1.84 | 23.40 | 1.93 | 20.00 |
| 7 | 1.62 | 22.50 | 1.73 | 19.10 |
| 8 | 1.44 | 21.50 | 1.57 | 18.30 |
| 9 | 1.28 | 20.50 | 1.42 | 17.50 |
| 10 | 1.15 | 19.50 | 1.30 | 16.60 |

*unchanged

As an alternative to modifying the die sizes of the last six blocks, only nine blocks could be used on the basis of the "initial draft" listed in the left-hand part of the table above, and just the ninth die changed to one of 1.30 mm diameter.

What is claimed is:

1. A method of determining a drawing die drafting sequence for a plurality of at least three successive drawing dies of decreasing cross-sectional areas of a multi-die/block drawing machine comprising choosing the relative cross-sectional areas of the plurality of dies so that the logarithm of the ratio of the product of the initial and final cross-sectional areas of material approaching and leaving each pair of successive dies of the plurality of dies to the square of the cross-sectional area of the material between the successive dies is substantially a constant throughout the sequence.

2. A method of determining the drawing die drafting sequence for a plurality of at least three successive drawing dies of decreasing cross-sectional areas of multi-die/block drawing machine operating with circular cross-section material comprising determining the cross-sectional area of each of the plurality of dies for a maximum taper on the basis of the method of claim 1 starting from an early die and assuming a reasonable maximum area reduction at that early die and determining the cross-sectional area of each of the plurality of dies for a minimum taper on the basis of the method of claim 1 starting from the final die and assuming a minimum area reduction at that final die to give acceptable machine performance, displaying the input stock size and the die sequence for the maximum taper as diameters for the input stock and the various dies spaced apart along one limit line of a nomogram and the input size and the die sequence for the minimum taper as die diameters for the input stock and the various dies spaced apart along a further limit line, spacing the diameters for the input stock and the various dies along each limit line at a distance $(Z-L_n)$ from a base line, joining the designations for the input stock and each die on each limit line by a plurality of parallel lines (input stock line and die lines) and graduating each such line between the limit lines in accorance with the modulus $M_{d_n}$ and then selecting the die sequence as the points where a straight line which passes through the desired points on the input stock line and the final die line and which intersects the base line, crosses the graduations of the other die lines, where $Y_n$ equals the physical length of the stock or die line in question, $d_{n_{max}}$ equals the diameter of the stock ($n=0$) or die ($n$ equals the die number) under conditions of maximum taper and $d_{n_{min}}$ equals the appropriate diameter under conditions of minimum taper, Z equals the physical separation between the input stock line and the base line, $$L_n = \frac{Z \cdot M_{d_n}}{M_{d_n} + M_{\frac{1}{2}\log(1-R_n)}} \text{ where}$$

$$M_{d_n} = \frac{Y_n}{\log d_{n_{max}} - \log d_{n_{min}}} \text{ and}$$

$$M_{\frac{1}{2}\log(1-R_n)} = \frac{x}{\frac{1}{2}[\log(1-R_{n_{min}}) - \log(1-R_{n_{max}})]}$$

$R_{n_{max}}$ being the maximum overall reduction and $R_{n_{min}}$ the minimum overall reduction at the $n^{th}$ die.

3. A method of drawing wire from a known input stock size to an end product of a desired size through a plurality of at least three successive drawing dies of decreasing cross-sectional areas of a multi-die/block drawing machine which comprises determining a drafting sequence by the method in claim 2, employing dies of the sizes and in the positions indicated by that sequence and drawing input stock of the stated size through the die sequence to obtain the required end product.

4. A method of determining a drafting sequence for a plurality of at least three successive drawing dies of decreasing cross-sectional areas of a multi-die/block drawing machine according to claim 1 wherein the dies are chosen by employing a nomogram comprising first and second sets of parallel graduated lines, the first set (die lines) indicating ranges of die apertures for each die in the sequence and the second set (area lines) indicating the overall area reduction effected at each die in the sequence expressed as a percentage of the area of cross-section of the input stock, the spacing $(Z-L_n)$ of the die lines from a base line of the area lines and the graduations of the die apertures along each die line being effected on the basis of a modulus $(M_{d_n})$ where $Y_n$ equals the physical length of the stock or die in question, $d_{n_{max}}$ equals the diameter of the stock ($n=0$) or die ($n$ equals the die number) under conditions of maximum taper and $d_{n_{min}}$ equals the appropriate diameter under conditions of minimum taper, $Z$ equals the physical separation between the input stock line and the base line, $$L_n = \frac{Z \cdot M_{d_n}}{M_{d_n} + M_{\frac{1}{2}\log(1-R_n)}} \text{ where}$$

$$M_{d_n} = \frac{Y_n}{\log d_{n_{max}} - \log d_{n_{min}}} \text{ and}$$

$$M_{\frac{1}{2}\log(1-R_n)} = \frac{x}{\frac{1}{2}[\log(1-R_{n_{min}}) - \log(1-R_{n_{max}})]}$$

$R_{n_{max}}$ being the maximum overall reduction and $R_{n_{min}}$ the minimum overall reduction at the $n^{th}$ die.

* * * * *